US006443596B1

(12) United States Patent
Bulko et al.

(10) Patent No.: US 6,443,596 B1
(45) Date of Patent: Sep. 3, 2002

(54) SURGICAL LIGHT APPARATUS WITH IMPROVED COOLING

(75) Inventors: John M. Bulko, Apex; Gerald L. Yeaney; Michael A. Taft, both of Raleigh, all of NC (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 09/050,529

(22) Filed: Mar. 30, 1998

Related U.S. Application Data

(60) Provisional application No. 60/079,667, filed on Mar. 27, 1998.

(51) Int. Cl.[7] ..... F21V 9/00

(52) U.S. Cl. ..... 362/293; 362/33; 362/804

(58) Field of Search ..... 362/96, 293, 294, 362/345, 373, 33, 804, 267

(56) References Cited

U.S. PATENT DOCUMENTS

| | | | | |
|---|---|---|---|---|
| 2,002,313 A | * | 5/1935 | Doane | 362/293 |
| 2,297,781 A | | 10/1942 | Korengold | |
| 3,075,071 A | | 1/1963 | Lauterbach | |
| 3,609,335 A | | 9/1971 | Kelly | |
| 4,032,771 A | | 6/1977 | Ilzig | |
| 4,037,096 A | | 7/1977 | Brendgord et al. | |
| 4,135,231 A | | 1/1979 | Fisher | |
| 4,181,926 A | | 1/1980 | Kockott et al. | |
| 4,254,454 A | | 3/1981 | Hardin, Jr. | |
| 5,067,064 A | | 11/1991 | Gehly et al. | |
| 5,072,349 A | | 12/1991 | Waniga | |
| 5,099,405 A | | 3/1992 | Gehly et al. | |
| 5,199,785 A | * | 4/1993 | Scholz | 362/804 |
| 5,331,530 A | * | 7/1994 | Scholz | 362/293 |
| 5,465,195 A | * | 11/1995 | Jenner et al. | 362/294 |

FOREIGN PATENT DOCUMENTS

| | | |
|---|---|---|
| DE | 2 023 625 | 12/1970 |
| DE | 196 21 853 | 12/1997 |
| GB | 927676 | 5/1963 |
| WO | WO 93/00550 | 1/1993 |

OTHER PUBLICATIONS

The American Society of Mechanical Engineers, "Design of a Sealed Surgical Lighting Fixture", 1985, 5 pages.
Berchtold Corporation, "Chromophare® C–571 Superior lighting technology is the secret of our success", 2/95, 8 pages.
Berchtold Corporation, "Chromophare® C–570 Service Manual", date unknown, 20 pages.

* cited by examiner

*Primary Examiner*—Y. My Quach-Lee
(74) *Attorney, Agent, or Firm*—Barnes & Thornburg

(57) ABSTRACT

A surgical light apparatus is disclosed having a first light source generating visible light and heat energy radiation, an enclosure surrounding the first light source and including a lens substantially transparent to visible light and a reflector for reflecting light from the first light source through the lens, and a filter apparatus coupled to the enclosure and formed at least in part from a material that is substantially transparent to at least a portion of visible light radiation and that substantially blocks transmission of heat energy radiation The filter apparatus is configured to block transmission of heat energy radiation from the first light source to the reflector and to intercept substantially all radiation from the first light source that otherwise would pass to the reflector and through the lens. The filter apparatus includes a plurality of filter elements configured to define at least one gap between two adjacent filter elements allowing air flow therethrough.

17 Claims, 6 Drawing Sheets

SURGICAL LIGHT APPARATUS WITH IMPROVED COOLING

This application claims benefit of prov. No. 60/079,667 filed Mar. 27, 1998.

BACKGROUND AND SUMMARY OF THE INVENTION

The present invention relates to a surgical light apparatus, and particularly a surgical light apparatus having improved cooling capability. More particularly, the present invention relates to a lighthead of a surgical light apparatus that blocks radiant heat energy from reaching a target area to be illuminated while providing for cooling of the lighthead.

Surgical lights used in hospital operating rooms to illuminate surgical sites on patients are known. Surgical lights employ one or more lamps, such as a tungsten halogen lamp, that convert electrical input to visible light. The conversion of electrical energy to light by a light bulb can be relatively inefficient, and over ninety percent of the input energy can be transmitted from the bulb as radiant heat.

The desirability of illuminating the target area to be lighted with cold light, that is, only visible light, is also known. Thus, surgical lights often include a filter in the lighthead to remove unwanted radiation, such as infrared radiation, so that only visible light is transmitted to the target area. For example, U.S. Pat. No. 4,254,455 to Neal, Jr. discloses a lighting device in which a curved reflector includes a dichroic coating that reflects only visible light. Removing heat energy radiation prior to illuminating the target area, however, can result in temperatures increasing within the surgical lighthead.

Thus, many known surgical lights provide a mechanism to remove unwanted heat from the surgical lighthead. In the above-identified patent to Neal, Jr., for example, the dichroic coating that reflects visible light allows heat energy to pass through the reflector to be radiated from the back of the lighthead. As another example, U.S. Pat. No. 4,254,454 to Hardin, Jr. discloses a lighting device in which airflow passages provide for cooling the lighting device by drawing external air through the lighting device.

Many surgical procedures use tools such as lasers and electro cautery units that periodically result in the generation of smoke during the surgical procedure. A surgical light fixture design that relies on flow of external air through the lighthead or cooling can cause the smoke to be drawn inside the lighthead, resulting in deposits from the smoke onto internal components. This can degrade the optical performance and require cleaning of the internal components.

According to the present invention, a surgical light apparatus has a light source and an enclosure surrounding the light source. The enclosure includes a reflector and a lens substantially transparent to visible light. The light source generates visible light and heat energy radiation. The surgical light apparatus includes at least one filter element formed at least in part from a material that is substantially transparent to at least a portion of visible light radiation and that substantially blocks transmission of heat energy radiation. The one or more filter elements are coupled to the enclosure and configured to block transmission of heat energy radiation from the light source to the reflector substantially over a 360° field of view about a longitudinal axis through the light source. The at least one filter element includes a first end longitudinally spaced from a second end and is configured to define at least one gap between the first and second ends.

The heat energy radiation can include infrared radiation. The at least one filter element can be configured to block radiation having a predefined range of wavelengths. According to another aspect of the invention, the gap can extend from the first end to the second end of the at least one filter element.

According to yet another aspect of the invention, the light source can include first and second light sources. The first light source has a first longitudinal axis and second light source has a second longitudinal axis that is spaced apart from and parallel to the first longitudinal axis. The at least one filter element is configured to block transmission of heat energy radiation from the first light source to the reflector substantially over a 360° field of view about the first axis and to block heat energy radiation from the second light source to the reflector substantially over a 360° field of view about the second axis.

According to still other aspects of the invention, the enclosure can be substantially sealed or hermetically sealed to prevent entry of air into the enclosure. The lens can be an acrylic lens and can be substantially transparent to heat energy radiation. The reflector can include an aluminum reflecting surface which furthermore can be opaque.

According to yet still another aspect of the invention, the at least one filter element comprises a plurality of filter segments. The filter segments can be configured as rectangular filter plates. The filter plates are spaced apart in a pattern to define gaps between each pair of adjacent filter plates.

According to another aspect of the invention, the reflector can be configured to reflect both visible light and heat energy radiation toward the lens. The reflector can be devoid of any coating that selectively filters visible light and heat energy radiation.

According to yet another aspect of the invention, the lens can be substantially transparent to visible light and to heat energy radiation. The lens can be devoid of any coating that selectively passes visible light and that blocks heat energy radiation.

According to still another aspect of the invention, an apparatus for cooling a surgical light fixture has a light source and an enclosure surrounding the light source. The enclosure includes a reflector configured to reflect light from the light source towards a lens that is transparent to visible light. The apparatus includes a plurality of filter elements coupled to the enclosure between the light source and the reflector. The filter elements are formed at least in part from material that is substantially transparent to visible light radiation and that substantially blocks transmission of heat energy radiation. The filter elements are configured to intersect substantially all radiation from the light source that otherwise would pass to the reflector and through the lens. The filter elements are configured to define at least one gap between two adjacent filter elements.

According to yet still another aspect of the invention, the filter elements can be configured to provide a gap between each pair of adjacent filter elements. The filter elements can be rectangular filter plates. Each filter plate can have substantially the same shape.

According to another aspect of the invention, the plurality of filter elements can include a first set of filter plates and a second set of filter plates. The first set of filter plates is interleaved with the second set of filter plates so that each filter plate of the first set of filter plates is adjacent two filter plates of the second set of filter plates. The adjacent filter plates are separated by a gap. The first set of filter plates is arranged in a first pattern and the second set of filter plates is arranged in a second pattern spaced radially outward of the first set of filter plates.

According to still another aspect of the invention, the plurality of filter elements can include four inner filter plates spaced apart in a first square pattern and four outer filter plates spaced apart in a second square pattern located radially outward of the first square pattern. The second square pattern is rotationally offset from the first square pattern by about 45°.

According to yet still another aspect of the invention, the plurality of filter elements can include a plurality of filter plates. Each filter plate has a front, a back, a first side edge, and a second side edge. The plurality of filter plates are arranged in a pattern around the light source with the front of each filter plate facing toward the light source and the back of each filter plate facing away from the light source. The first side edge of each filter plate is spaced apart from the second side edge of an adjacent filter plate and located radially inward toward the light source from the second side edge of the adjacent filter plate.

According to another aspect of the invention, a surgical light apparatus includes a pivoting arm assembly and a lighthead coupled to an end of the pivoting arm assembly. The lighthead includes a housing, a light source, a lens, a reflector configured to reflect light from the light source through the lens, and a filter element. The filter element is coupled between the reflector and the light source to intersect substantially all radiation emanating from the light source toward the reflector. The filter element is configured to block heat energy radiation and to pass visible light. The filter element has at least two segments spaced apart to define an air gap therebetween.

According to yet another aspect of the invention, the filter element can include a plurality rectangular filter plates arranged in a pattern to provide a gap between each pair of adjacent filter plates. The plurality of filter plates can include a first plurality of filter plates arranged in a first pattern and a second plurality of filter plates arranged in a second pattern positioned radially outward of the first pattern. The plurality filter plates can include four inner filter plates spaced apart in a first square pattern and four outer filter plates spaced apart in a second square pattern positioned radially outward of the first square pattern and rotationally offset from the first square pattern by about 45°.

According to still another aspect of the invention, an apparatus for cooling a surgical light fixture having a light source and an enclosure surrounding the light source is provided. The enclosure includes a reflector configured to reflect light from the light source towards a lens that is transparent to visible light. The apparatus includes a filter coupled to the enclosure, the filter including means for blocking heat energy radiation emitted from the light source and means for permitting air flow between the reflector and the light source.

Additional features of the invention will become apparent to those skilled in the art upon consideration of the following detailed description of the presently perceived best mode of carrying out the invention.

BRIEF DESCRIPTION OF THE DRAWINGS

The detailed description particularly refers to the accompanying figures in which.

DETAILED DESCRIPTION OF THE DRAWINGS

Figure 1:
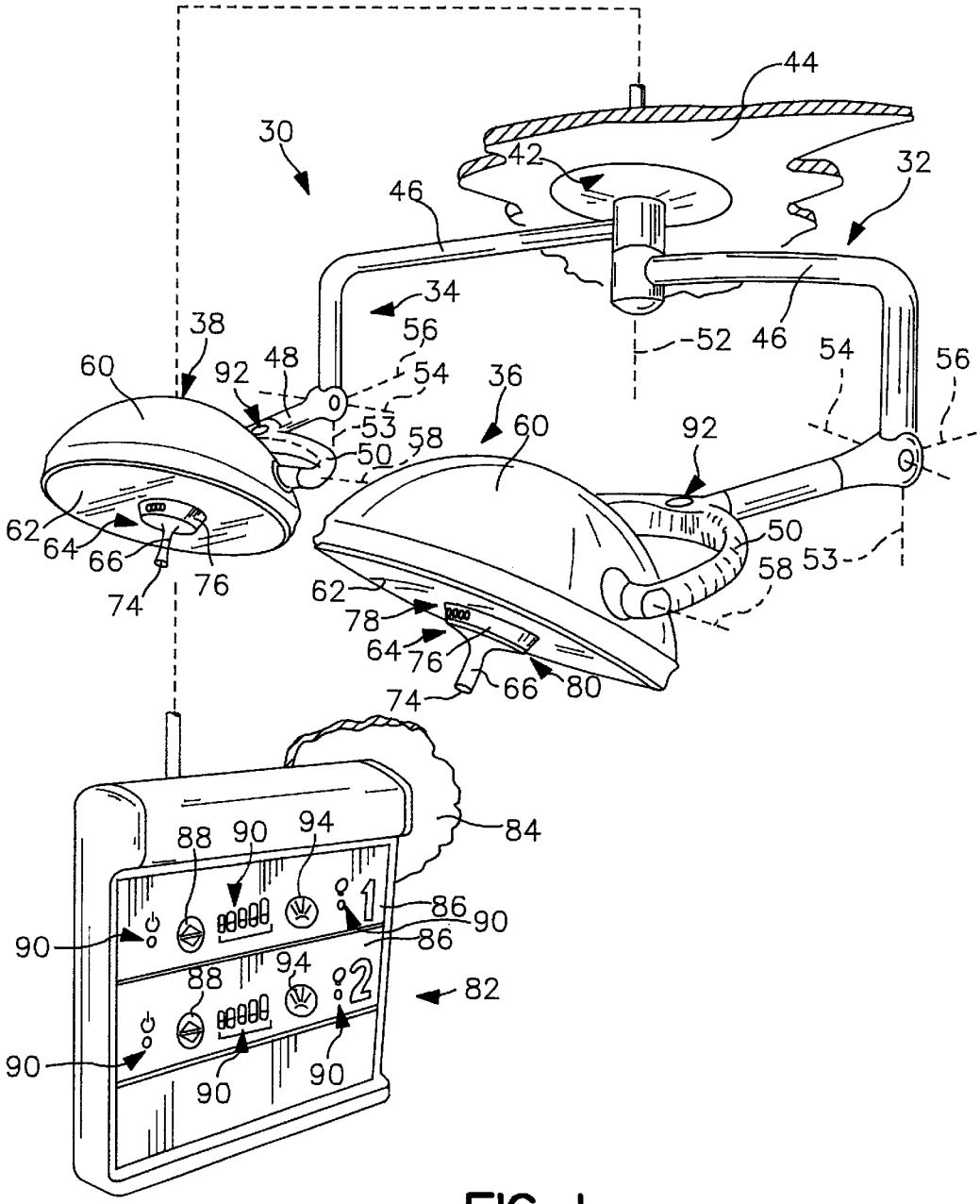
FIG. 1 is an isometric view of a surgical light system in accordance with the present invention showing a first surgical lighthead suspended from a ceiling of a hospital room by a first arm assembly, a second surgical lighthead suspended from the ceiling of the hospital room by a second arm assembly, and a light-controller box mounted to a wall of the hospital room.

A surgical light system 30 includes a first arm assembly 32, a second arm assembly 34, a first lighthead 36 coupled to first arm assembly 32, and a second lighthead 38 coupled to second arm assembly 34 as shown in FIG. 1. First and second arm assemblies 32, 34 each couple to a common mounting apparatus 42 which is configured to mount to suitable support structure (not shown) associated. with a ceiling 44. It is understood that first and second arm assemblies 32, 34 may be mounted to any suitable support such as a wall or separate stand.

Each arm assembly 32, 34 includes an L-shaped upper or first arm 46, a lower or second arm 48, and a yoke 50. Each first arm 46 is independently pivotable relative to mounting apparatus 42 about a vertical pivot axis 52. Each second arm 48 is pivotable relative to the respective first arm 46 about a respective horizontal or main pivot axis 54 and about a respective vertical pivot axis 53 that is spaced from pivot axis 52. In addition, each yoke 50 is pivotable relative to the respective second arm 48 about a respective pivot axis 56 and each of lightheads 36, 38 is pivotable relative to the respective yoke 50 about a respective pivot axis 58. Thus, arm assemblies 32, 34 and lightheads 36, 38 are movable to a variety of positions relative to ceiling 44.

Each lighthead 36, 38 includes a dome-shaped housing 60, a lens 62 through which light shines from the respective lighthead 36, 38, and a handle assembly 64 as shown in FIG. 1. Each handle assembly 64 includes a handle 66 which is grasped by a surgeon to move the respective lighthead 36, 38 and associated arm assembly 32, 34 to a desired position. Each lighthead 36, 38 includes one or more light bulbs (not shown) and each lighthead 36, 38 includes a reflector (not shown) that reflects light emanating from the at least one light bulb to illuminate a surgical site on a patient. Each lighthead 36, 38 also includes a light absorption filter (not shown) that is fabricated from specially formulated glass to filter most of the near and intermediate infra-red emissions from the at least one light bulb.

Handle 66 of each handle assembly 64 is rotatable to move the at least one light bulb relative to the reflector to adjust the pattern size of reflected light that illuminates the surgical site. The pattern size may be thought of generally as the diameter of the area illuminated by the associated lighthead 36, 38. In addition, handle assembly 64 includes a button 74 at the bottom of handle 66 which is pressed to adjust the intensity level at which light emanates from the at least one light bulb. Handle assembly 64 includes an escutcheon 76 above handle 66. Handle assembly 64 further includes a first set of LED's 78 and a second set of LED's 80 that are visible on respective sides of escutcheon 76 to provide user information regarding the operation of the at least one light bulb and the intensity level at which light is emanating from the at least one light bulb. In preferred embodiments, each of the at least one light bulb is a tungsten halogen lamp.

Surgical light system 30 includes a controller box 82, shown in FIG. 1, which is mounted to a wall 84 or other suitable structure and which is coupled electrically to surgical lightheads 36, 38 to control the operation of the at least one light bulb. Controller box 82 includes a control panel 86 having buttons 88 and sets of LED's 90 that are associated with each respective lighthead 36, 38. Each set of LED's 90 is arranged similarly and provides the same information as LED's 78, 80 of the respective lighthead 36, 38. In addition, each button 86 is pressed to change the light intensity of the at least one light bulb in the same manner that button 74 of the associated lighthead 36, 38 is pressed to change the light intensity of the at least one light bulb. Thus, the operation of the at least one light bulb is controllable either with the respective handle assembly 64 or controller box 82. Surgical light system 30 optionally may include a task light 92, shown in FIG. 1, and controller box 82 optionally may include a button 94 that is pressed to turn task light 92 on and off.

Other features of surgical light system 30 are discussed and shown in detail in co-pending patent applications Ser. No. 09/050,530; Ser. No. 09/050/265; Ser. No. 29/050/265; Ser. No. 29/085/726; Ser. No. 09/050,534; Ser. No. 09/050,576 Ser. No. 29/085,751 and Ser. No. 29/085,727, all of which are hereby incorporated by reference herein. Each of the incorporated applications are owned by the assignee of the present application.

Each lighthead 36, 38 includes a combination light and heat radiation filter apparatus 10 as shown in FIGS. 2–7. Filter apparatus 10 is positioned within housing 60 and configured to encircle light bulbs 68, 70 to intersect light and heat energy radiating from bulbs 68, 70 that otherwise would pass unimpeded towards reflector 72 to be reflected towards lens 62 and out of lighthead 36, 38. Filter apparatus 10 illustratively includes a plurality of rectangular filter plates 12 fabricated from specially formulated glass that filters the visible light to produce light of a desired color while absorbing most of the heat energy radiation radiated from either of bulbs 68, 70. It is understood that any suitable material that permits passage of a desired spectrum of visible light while blocking a desired spectrum of heat energy radiation can be used.

Illustratively, the filter plates 12 can be configured to block a predefined spectrum of heat energy radiation such as infrared radiation. In addition, filter plates 12 can be configured to filter visible light to remove a predefined spectrum of visible light.

Figure 2:
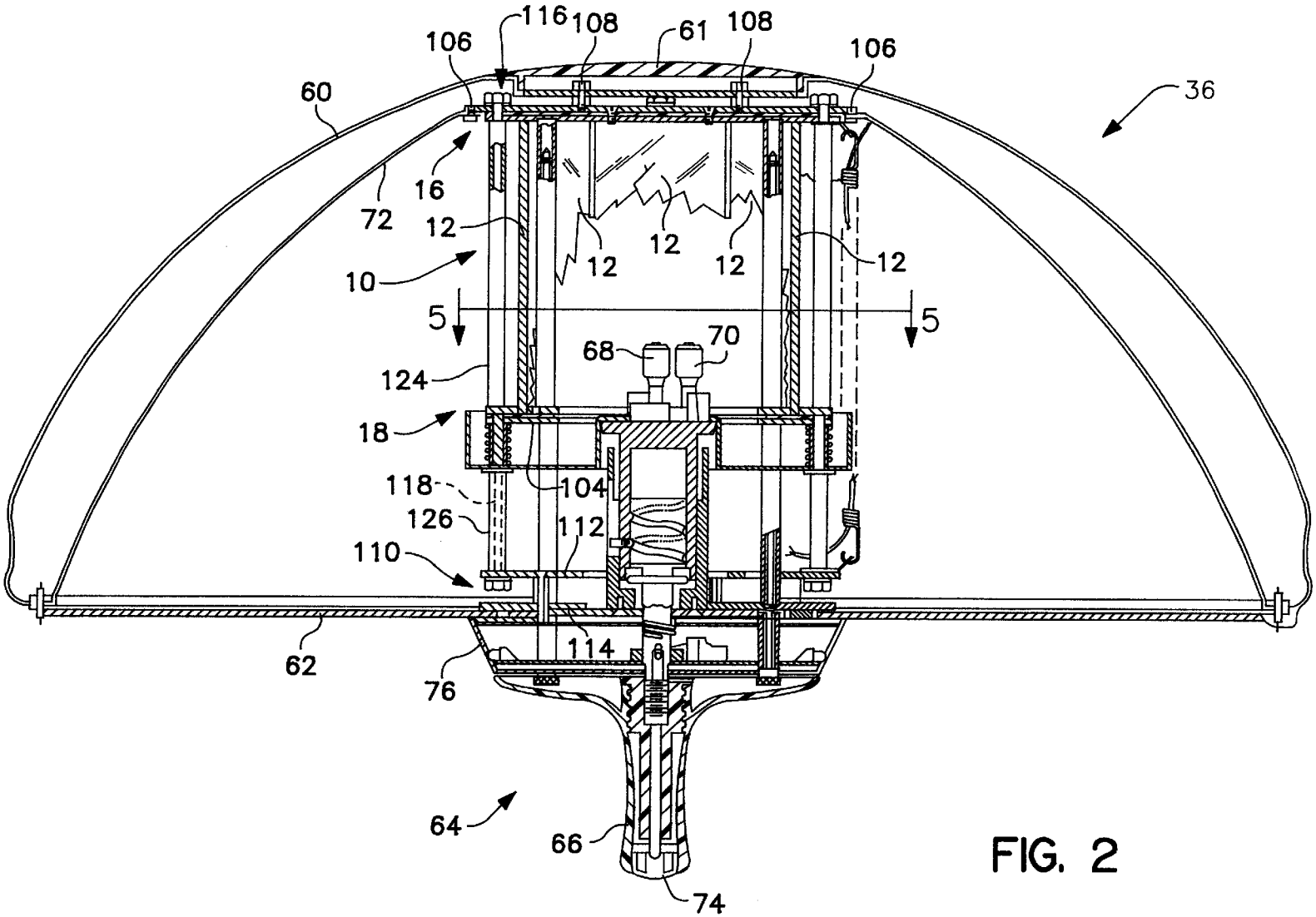
FIG. 2 is a sectional view of the first surgical lighthead of FIG. 1, taken along line 2—2, showing a dome-shaped outer cover, a dome-shaped reflector surrounded by the outer cover, a lamp assembly surrounded by the reflector including a combination light and heat energy radiation filter apparatus with portions broken away to show a main light bulb and a redundant light bulb, and a handle assembly coupled to the lamp assembly.
Figure 3:
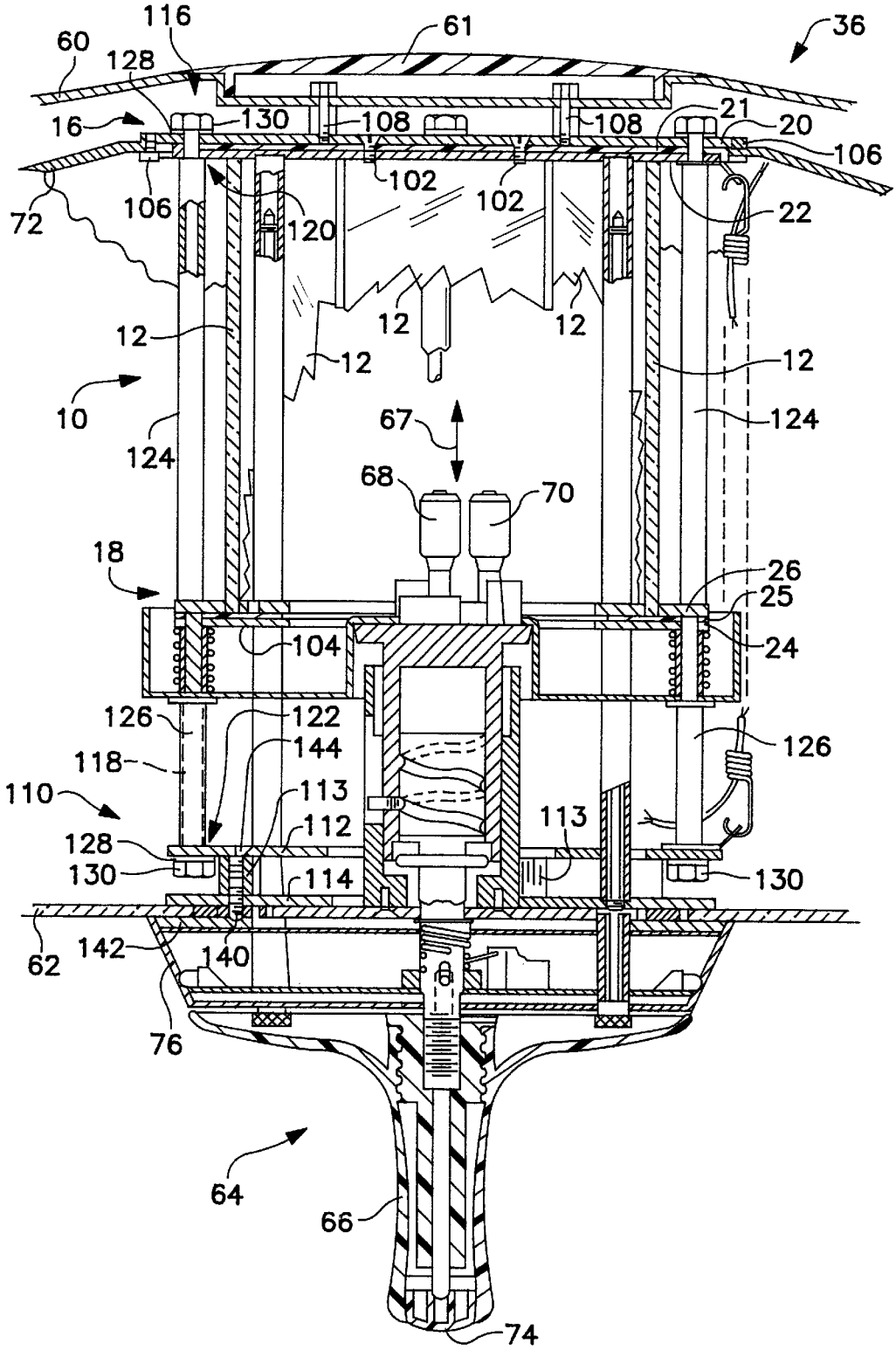
FIG. 3 is an enlarged view of a portion of FIG. 2 showing the lamp and handle assemblies.
Figure 4:
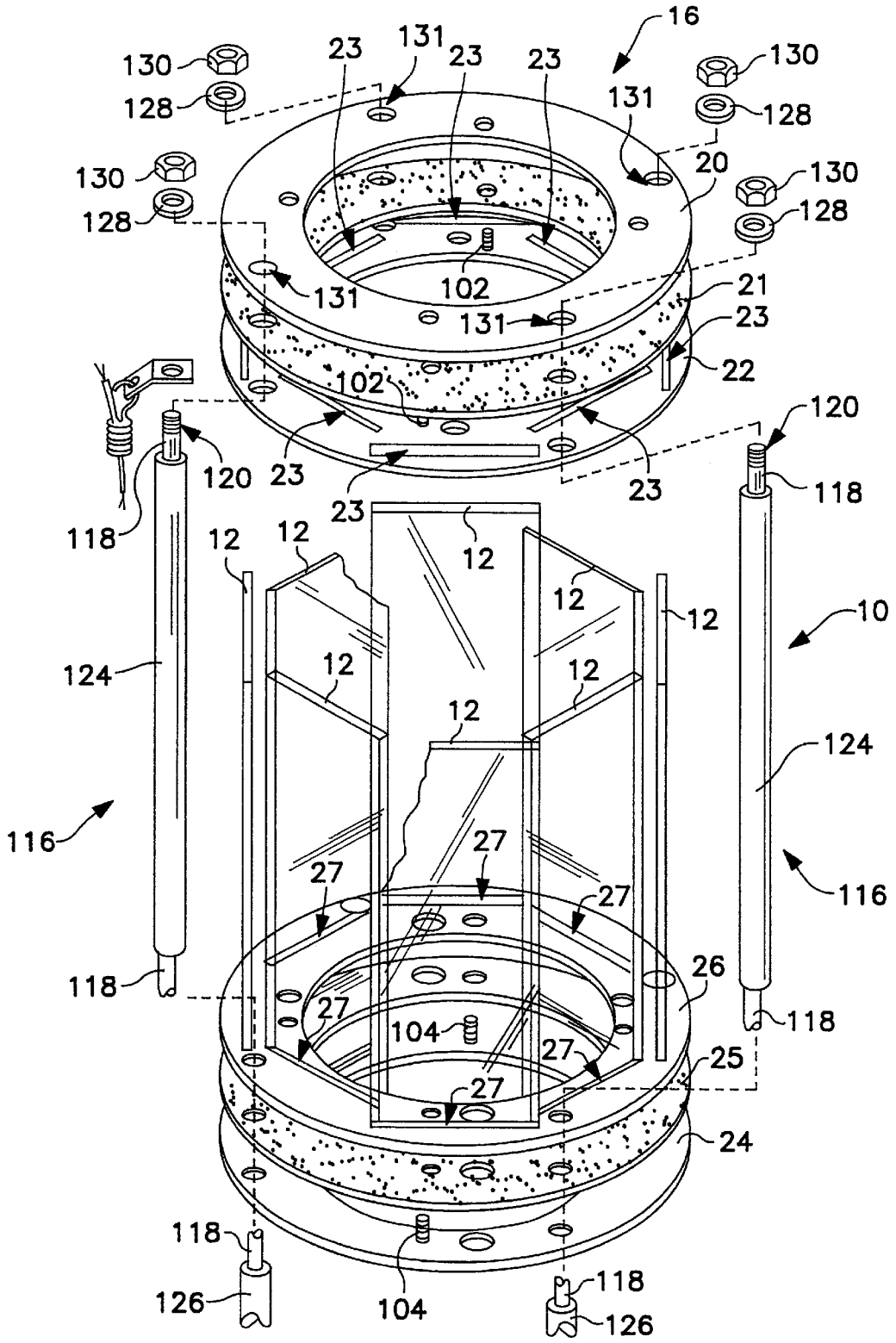
FIG. 4 is an exploded perspective view of the combination light and heat energy radiation filter apparatus of FIG. 2 illustrating eight rectangular filter plates and upper and lower plate-retaining assemblies.
Figure 5:
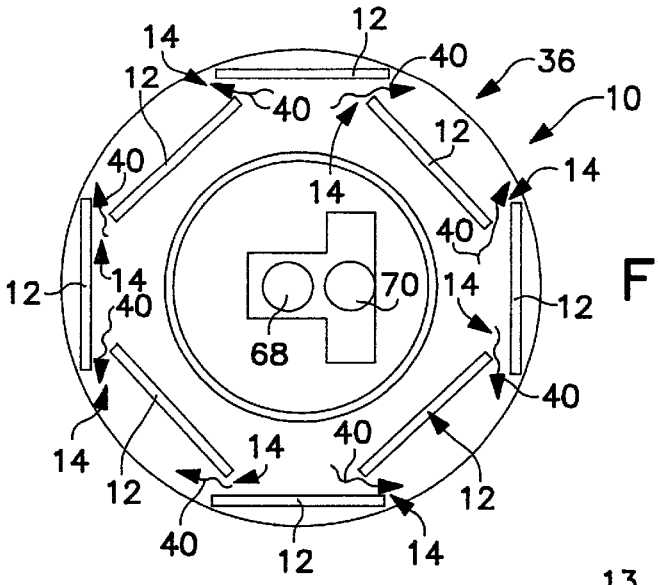
FIG. 5 is a top plan view taken along line 5—5 of FIG. 2, showing the combination light and heat energy filter apparatus including eight rectangular filter plates spaced apart in a pattern to define gaps between adjacent plates for flow of air therebetween.

Filter plates 12 are retained between a pair of plate-receiving assemblies 16, 18 as best shown in FIGS. 2–4. Upper plate-receiving assembly 16 includes an annular top cover plate 20, an annular bottom plate 22 having plate-receiving slots 23, and an annular gasket 21 configured to lie between top and bottom plates 20, 22. Gasket 21 provides a compressible cushion for filter plates 12 when they are retained within assembly 16 as explained below. Top and bottom plates 20, 22 are coupled together by four screws 102. Upper plate-receiving assembly 16 is coupled to reflector 72 by four screws 106 and to housing 60 by four screws 108 as shown in FIGS. 2 and 3. Housing 60 includes a removable top cover 61 to conceal screws 108.

Similar to upper plate-receiving assembly 16, lower plate-receiving assembly 18 includes an annular bottom cover plate 24, an annular top plate 26 having plate-receiving slots 27, and an annular gasket 25 configured to lie between bottom and top plates 24, 26. Gasket 25 performs the same function as gasket 21 above. Lower plate-receiving assembly bottom and top plates 24, 26 are similarly coupled together by four screws 104.

Lightheads 36, 38 include a filter support assembly 110 that includes upper and lower annular support plates 112, 114 spaced apart by spacers 113 as shown in FIGS. 2–4. Upper and lower plate-receiving assemblies 16, 18 are coupled to upper support plate 112 of filter support assembly 110 by four rod assemblies 116. Each rod assembly 116 includes a rod 118 having an upper threaded end 120 and a lower threaded end 122, a filter plate spacing tube 124, a support assembly spacing tube 126, and washers 128 and nuts 130. The threaded ends 120 of rods 118 extend through apertures 131 found in top plate 20, gasket 21 and bottom plate 22 to permit attachment of the washers 128 and nuts 130 to the rods 118 as shown in FIGS. 2 and 3.

Filter plate and support assembly spacing tubes 124, 126 are sized so that rod 118 can extend axially through them. Filter plate spacing tube 124 has an axial length to space lower plate 22 of upper plate-receiving assembly 16 apart from upper plate 26 of lower plate-receiving assembly 18 so that filter plates 12 are snugly received in plate-receiving slots 23, 27 with gaskets 21, 25 cushioning and protecting the ends of filter plates 12. Support assembly spacing tube 126 has an axial length defined by the distance between upper plate 112 of filter support assembly 110 and bottom cover plate 24 of lower plate-retaining assembly 18 when filter 10 is coupled to housing 60 and reflector 72 as shown in FIGS. 2 and 3. Washers 128 and nuts 130 are attached to upper and lower threaded ends 120, 122 of rod 118 to secure filter apparatus 10 within lighthead 36, 38.

Filter support assembly 110 is coupled to the lens 62 by fasteners 140 which extend through mounting plate 142, through plate 114 and into threaded spacers 113 as shown best in FIG. 3. Fasteners 144 extend through plate 112 and into the other threaded end of spacers 113. Therefore the filter apparatus 10 is held in a desired location within an enclosure defined by housing 60 and lens 62.

As handle 66 is rotated, bulbs 68 and 70 move up and down in the direction of double headed arrow 67 in FIG. 3. Details of the movement of bulbs are described in copending application Ser. No. 09/050,534 referenced above.

In an illustrated embodiment of FIGS. 2–7, eight filter plates 12 are spaced apart in a generally octagonal pattern as best shown in FIGS. 4–7, with gaps 14 between adjacent filter plates 12. Gaps 14 between the filter plates 12 advantageously lower the thermal resistance of filter 10 by allowing for flow of air as shown by arrows 40 in FIG. 5. Thus, as air in the vicinity of light bulbs 68, 70 and filter plates 12 increases in temperature due to radiation of heat from bulbs 68, 70 and absorption of heat by filter plates 12, the gaps 14 permit convective airflow across filter apparatus 10 to assist in dissipating heat within lighthead 36. The prevention of localized heat buildup within lighthead 36 results in improved operation, such as increased life expectancy for bulbs 68, 70 and a lower overall operating temperature within housing 60. As discussed below, the improved cooling permits the use of higher wattage bulbs to provide additional light and improve illumination at a surgical site while maintaining acceptable temperatures with the surgical light apparatus.

Although lighthead 36, 38 according to the present invention is sealed against external airflow into the enclosure defined by housing 60 and lens 62, it is understood that convective airflow encouraged by filter apparatus 10 will improve cooling irrespective of whether a lighthead is hermetically sealed, nominally sealed, or passageways for introduction of external air into the lighthead are provided.

The octagonal shape of FIGS. 4–7 includes four inner filter plates 12 spaced apart in a first square pattern and four outer filter plates 12 spaced apart in a second square pattern spaced radially outward of the first square pattern, with the square patterns being rotationally offset by 45°. In this configuration, left and right side edges 13, 15 of inner filter plates 12 are positioned radially inward of side edges 13, 15 of the outer filter plates 12. Optionally, each of the eight filter plates 12 can be positioned in an alternative octagonal pattern so that left side edge 13 of each filter plate 12 is spaced apart and radially inward of right side edge 15 of an adjacent filter plate. In this optional configuration, the eight filter plates 12 are each positioned uniformly relative to a geometric center of the pattern of the octagonal pattern with a rotational offset of 45° between adjacent filter plates when viewed from the center of the pattern.

Figure 6:
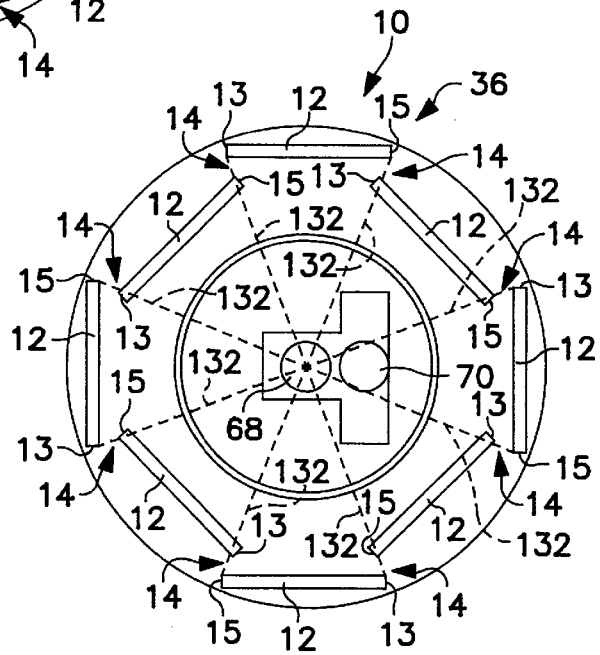
FIG. 6 is a top plan view similar to FIG. 5, showing light and heat radiation paths from the main light bulb toward the filter plates.
Figure 7:
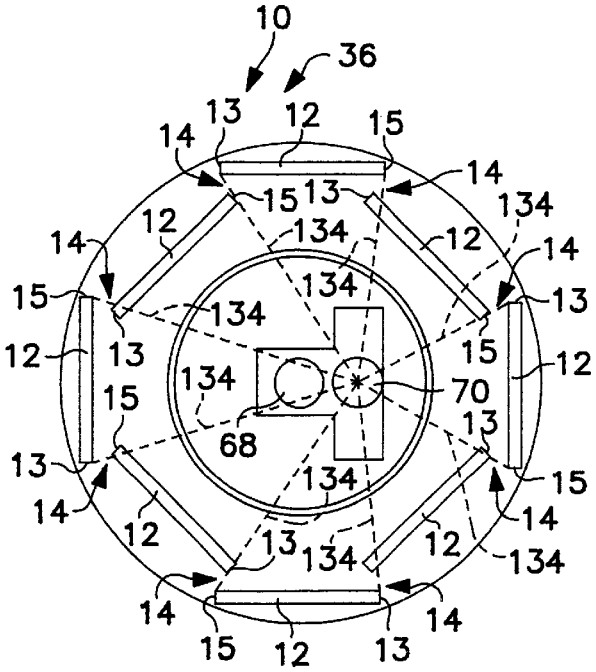
FIG. 7 is a top plan view similar to FIG. 5, showing light and heat radiation paths from the redundant light bulb toward the filter plates.

Main light bulb 68 in preferred embodiments is positioned at the geometric center of the pattern of filter plates 12, as best shown in the octagonal pattern of FIG. 6. Filter plates 12 are sized so that left and right side edges 13, 15 of radially inward filter plates 12 block light and heat energy radiation from main light bulb 68 radiating toward left and right side edges 13, 15 of radially outward filter plates as illustrated by radiation lines 132. Thus, gaps 14 are obscured from a direct line of sight of radiation from main light bulb 68, and light and heat radiation is blocked over a 360° field of view looking radially outward from main light bulb 68. Similarly, as shown by radiation lines 134 in FIG. 7, left and right side edges 13, 15 of radially inward filter plates 12 block radiation from redundant light bulb 70 radiating toward left and right side edges 13, 15 of radially outward filter plates 12 to block heat energy radiation from the second light source over a 360° field of view looking radially outward from redundant light bulb 70.

Filter apparatus 10 according to the present invention provides improved cooling so that, for example, a sealed surgical lighthead 36, 38 having a 3150° K. tungsten halogen lamp rated between about 180 to about 190 watts can maintain a temperature of less than about 500° F. for filter plates 12 configured to produce a filtered light color temperature of about 4200° K. Filter apparatus 10 provides for a total integrated spectral transmittance (filter lumen output divided by lamp lumen input) of at least about 64% and a maximum heat to light ratio (sum of visible, ultraviolet, and infrared energy divided by total footcandles) of about 3.8 $\mu W/cm^2$-footcandle. Advantageously, this level of cooling is obtained without additional heat radiation filter elements on either reflector 72 or lens 62, such as a thin film coating that selectively filters visible light and heat energy radiation. Further advantageously, this level of cooling can be maintained for any orientation of lighthead 36, 38. Thus, for example, lighthead 36, 38 can be positioned continuously in an inverted orientation with an acrylic lens 62 facing toward ceiling 44 without causing any optical distortion of the lens. Furthermore advantageously, this level of cooling can be obtained using a aluminum reflector 72 having an opaque surface.

The improved filter apparatus 10 of the present invention permits higher wattage bulbs 68, 70 to be used, while maintaining temperatures in the surgical lights within a desired range. This improves illumination at the surgical site. Illustratively, the bulbs 68, 70 have a wattage of about 180 W to about 190 W, while the temperature of the filter plates 12 is maintained at or below about 500° F. using the filter apparatus 10.

Figure 8:
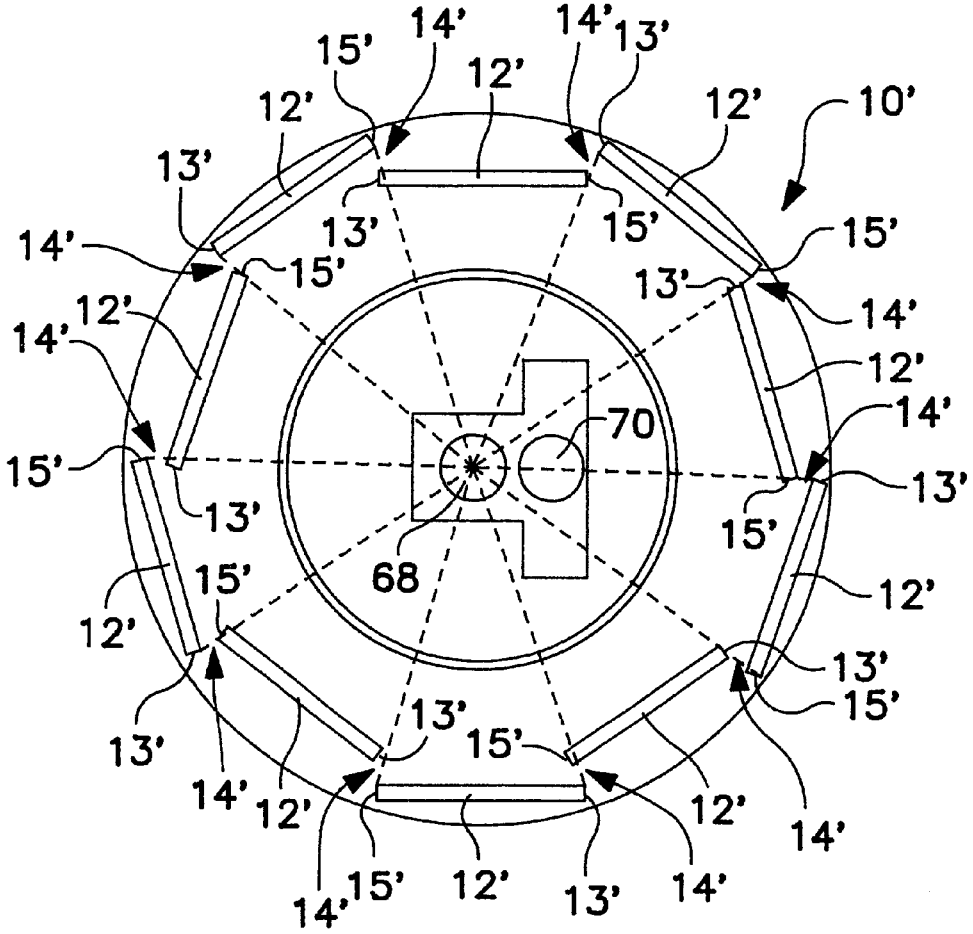
FIG. 8 is a top plan view of an alternative embodiment combination light and heat energy filter apparatus according to the present invention including ten filter plates spaced apart in a pattern to define gaps between adjacent plates, and showing light and heat radiation paths from a main light bulb toward the filter plates.

An alternative embodiment filter apparatus 10' employing ten filter plates 12' arranged in a decahedron pattern is shown in FIG. 8. Similar to the embodiment of FIGS. 2–7, left and right side edges 13', 15' of radially inward filter plates 12' block radiation from main and redundant light bulbs 68, 70 from reaching left and right side edges 13', 15' of radially outward filter plates 12'. Gaps 14' provide for convective airflow through filter apparatus 10' to enhance cooling of bulbs 68, 70 and filter plates 12'.

Thus, a light and heat energy radiation filter apparatus according to the present invention provides for improved cooling of a surgical lighthead by providing at least one gap within the filter element to allow convective airflow to enhance cooling of the lamps and filter elements. Providing gaps that are substantially obscured from a direct line of radiation from the light source while encouraging convective air flow past the filter provides for filtering substantially all light and heat energy radiation while reducing operating temperature.

Although the preferred embodiments use geometric arrangements of generally rectangular plates having gaps between adjacent plates, gaps can be provided by other means such as gaps between curved filter elements or by a unitary filter element formed to include at least one gap.

Although the invention has been described in detail with reference to certain illustrated embodiments, variations and modifications exist within the scope and spirit of the invention as described and as defined in the following claims.

What is claimed is:

1. An apparatus for cooling a surgical light fixture having a first light source and an enclosure surrounding the first light source, the enclosure including a reflector and a lens transparent to visible light, the reflector configured to reflect light from the first light source towards the lens, the apparatus comprising a plurality of filter elements coupled to the enclosure between the first light source and the reflector, the plurality of filter elements being formed at least in part from material that is substantially transparent to visible light radiation and that substantially blocks transmission of heat energy radiation, and the plurality of filter elements being configured to intersect substantially all radiation from the first light source that otherwise would pass to the reflector and through the lens, the plurality of filter elements being configured to define at least one gap between two adjacent filter elements.

2. The apparatus of claim 1 further comprising a second light source spaced apart from the first light source.

3. The apparatus of claim 1, wherein the plurality of filter elements are configured to provide a gap between each pair of adjacent filter elements.

4. The apparatus of claim 1, wherein the filter elements are rectangular filter plates.

5. The apparatus of claim 4, wherein each filter plate has substantially the same shape.

6. The apparatus of claim 1, wherein the plurality of filter elements includes a first set of filter plates and a second set of filter plates, the first set of filter plates being interleaved with the second set of filter plates so that each filter plate of the first set of filter plates is adjacent two filter plates of the second set of filter plates, and adjacent filter plates are separated by a gap.

7. The apparatus of claim 6, wherein the first set of filter plates is arranged in a first pattern and the second set of filter plates is arranged in a second pattern spaced radially outward of the first set of filter plates.

8. The apparatus of claim 1, wherein the plurality of filter elements comprises four inner filter plates spaced apart in a first square pattern and four outer filter plates spaced apart in a second square pattern located radially outward of the first square pattern and rotationally offset from the first square pattern by about 45°.

9. The apparatus of claim 1, wherein the plurality of filter elements comprises a plurality of filter plates, each filter plate having a front, a back, a first side edge, and a second side edge, the plurality of filter plates being arranged in a pattern around the light source with the front of each filter plate facing toward the light source, the back of each filter plate facing away from the light source, and the first side edge of each filter plate being spaced apart from the second side edge of an adjacent filter plate and located radially inward toward the light source from the second side edge of the adjacent filter plate.

10. The apparatus of claim 1, wherein the reflector is configured to reflect visible light and heat energy radiation toward the lens.

11. The apparatus of claim 1, wherein the reflector is devoid of a coating that selectively filters visible light and heat energy radiation.

12. The apparatus of claim 1, wherein the lens is substantially transparent to visible light and to heat energy radiation.

13. The apparatus of claim 1, wherein the lens is devoid of a coating that selectively passes visible light and that blocks heat energy radiation.

14. The apparatus of claim 1, wherein the heat energy radiation includes infrared radiation.

15. The apparatus of claim 1, wherein at least one filter element blocks a predefined spectrum of heat energy radiation.

16. A surgical light apparatus having a first light source, a second light source, and an enclosure surrounding the first and second light sources and including a reflector and a lens substantially transparent to visible light, the first and second light sources generating visible light and heat energy radiation, the apparatus comprising a filter apparatus formed at least in part from a material that is substantially transparent to at least a portion of visible light radiation and that substantially blocks transmission of heat energy radiation, the filter apparatus being coupled to the enclosure and configured to Chock transmission of heat energy radiation from the first and second light sources to the reflector substantially over a 360° field of view about Longitudinal axes through the first and second light sources, the longitudinal axis through the first light source being spaced apart from and parallel to the longitudinal axis through the second light source, the filter apparatus including an inner face facing the light sources and an outer face facing away from the light sources and a first side end longitudinally spaced from a second side end, and the filter apparatus being configured to define at least one gap located between the first and second ends, the gap providing a passage allowing air flow between the inner face to the outer face.

17. A surgical light apparatus having a first light source and an enclosure surrounding the first light source and including a reflector and a lens substantially transparent to visible light, the first light source generating visible light and heat energy radiation, the apparatus comprising a filter apparatus formed at least in part from a material that is substantially transparent to at least a portion of visible light radiation and that substantially blocks transmission of heat energy radiation, the filter apparatus being coupled to the enclosure and configured to block transmission of heat energy radiation from the first light source to the reflector substantially over a 360° field of view about a longitudinal axis through the first light source, the filter apparatus including an inner face facing the light source and an outer face facing away from the light source, a first end longitudinally spaced from a second end, and the filter apparatus being configured to define at least one gap, the gap providing a passage allowing air flow between the inner face to the outer face; wherein, the filter apparatus includes a plurality of spaced-apart rectangular filter plates arranged to define gaps between each pair of adjacent filter plates.

* * * * *